United States Patent [19]

Chandek et al.

[11] Patent Number: 4,644,144

[45] Date of Patent: Feb. 17, 1987

[54] DOCUMENT CARRIER ENVELOPE

[76] Inventors: Anthony R. Chandek, S87 W25075 Edgewood Ave., Mukwonago, Wis. 53149; Leon J. Weistroffer, 1815 High St., Aurora, Ill. 60505; Donald E. Cooper, 720 Merritt Ct., Naperville, Ill. 60540; Daniel A. Bates, 4710 W. Bluemound Rd., Milwaukee, Wis. 53208

[21] Appl. No.: 733,984

[22] Filed: May 13, 1985

[51] Int. Cl.[4] ..... G06K 19/06

[52] U.S. Cl. ..... 235/487; 235/494

[58] Field of Search ..... 235/487, 494, 457

[56] References Cited

U.S. PATENT DOCUMENTS 4,117,975 10/1978 Gunn ..... 235/494

*Primary Examiner*—Harold I. Pitts

*Attorney, Agent, or Firm*—Fuller, Puerner & Hohenfeldt

[57] ABSTRACT

A document carrier envelope is particularly useful for protectively transporting checks being returned from an institution on which the check was written to the institution at which the check was deposited. The envelope is of opaque stock, thereby preserving confidentiality of the return check. The envelope is imprinted with coded indicia indicating specific financial data suitable for high speed processing. The envelope front and back panels are joined in facing contact along the margins of three edges, thereby reducing entry of air into the envelope and eliminating fouling the processing machinery. The envelope flap is notched to receive a letter opener, and the flap fold line is perforated, thereby contributing to high speed handling.

14 Claims, 4 Drawing Figures

DOCUMENT CARRIER ENVELOPE

BACKGROUND OF THE INVENTION

1. Field of the Invention.

This invention pertains to data processing, and more particularly to carriers for transporting documents through high speed data processing machines.

2. Description of the Prior Art.

High speed processing of checks is essential to modern finance. A recent estimate published in the Wall Journal stated that 60 million people in the United States have checking accounts and they write 100 million checks a day. To handle the huge volume of checks, financial institutions have invested heavily in automated check processing equipment. Checks are imprinted with an elaborate system of coded magnetic information that identifies the depositor and the institution on which the check is written. High technology processing machines and overnight carriers speed checks from the institutions in which they are deposited to the institutions on which they were written. The entire process frequently takes only two business days.

However, problems are encountered if the institution on which the check was written finds there is not enough money in the checking account to cover the check. In that situation, it has to send the check back to the institution where it was deposited. Checks must also be returned for other deficiencies, such as missing signatures or expired dates. One source estimates the number of returned checks approaches one million per day. Processing return checks is slow and inefficient. There is no organized system of magnetic information encoded on the checks for expediting their return to the institutions of deposit. Each institution handling a return check on its way back to the institution of deposit endorses the check. Such endorsements often obliterate the original endorsement, dates, and trace numbers, thus making traceback very difficult.

To alleviate the problems associated with processing return checks, special envelopes or carriers for the checks have been developed. One known return carrier is the MICRA 2-13 transparent document carrier. That carrier is not entirely satisfactory, however, because it is open on one side, thus allowing loss of the check. In addition, the open side permits air to become trapped within the carrier; the trapped air interferes with machinery through which the carrier may be processed. One face of the MICRA 2-13 transparent document carrier is made of a transparent material so that the magnetic coded symbols on the face of the check are visible. However, there is no provision for encoding the symbols associated with the returning institutions. Also, the transparent material destroys all confidentiality associated with the check.

To preserve confidentiality, it has been proposed to make the carrier completely of opaque material. Holes are provided in one or more of the carrier panels so that the presence or absence of a document inside can be detected. However, the holes permit air to become trapped inside the carrier, thereby fouling the processing machinery.

Other known document carriers are disclosed in U.S. Pat. Nos. 3,588,456; 3,431,404; and 2,693,909. Those carriers, however, suffer from the same general deficiencies as previously mentioned.

Thus, a need exists for a return check carrier which enables the check to be inexpensively and reliably processed through high speed equipment.

SUMMARY OF THE INVENTION

In accordance with the present invention, a carrier is provided for protectively transporting a document through high speed data processing systems in an efficient and reliable manner. This is accomplished by constructing the document carrier as a completely sealed envelope for carrying and protecting the document and encoding the envelope with information suitable for processing through the high speed equipment.

The envelope is manufactured totally from opaque material, thus preserving confidentiality of the enclosed document. The envelope material is preferably made from stock of accurately controlled thickness. The stock is preferably of a distinctive color that allows for easy detection when co-mingled with other documents in a document tray.

To minimize the quantity of air within the closed envelope of the present invention, the margins of the front and back panels are joined together, as by an adhesive, in facing contact along three sides thereof. As a result, the envelope faces have a natural tendency to lie flat in facing contact, rather than to spread apart as would be the case if the stock material were merely folded.

The envelope is closable by a flap that is secured by an adhesive or cohesive applied to the flap and a corresponding portion of an envelope panel. When the flap is closed, air bubbles do not form inside the envelope during machine processing to interfere with the processing machinery. To permit high speed processing on a return check, the envelope is encoded with information that identifies the check as a high speed return and the clearing house information. Additional coded information identifies the returning institution, the institution of deposit, and the check dollar amount.

Further in accordance with the present invention, the envelope flap is formed with a notch at one end thereof. The notch permits a conventional letter opener to be conveniently and rapidly inserted under the flap for opening the envelope, thus contributing to high speed operations. To further increase opening efficiency, the flap may be perforated along the fold line with the associated envelope panel. The perforations also permit escape of air.

Other objects and advantages of the invention will become apparent to those skilled in the art from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
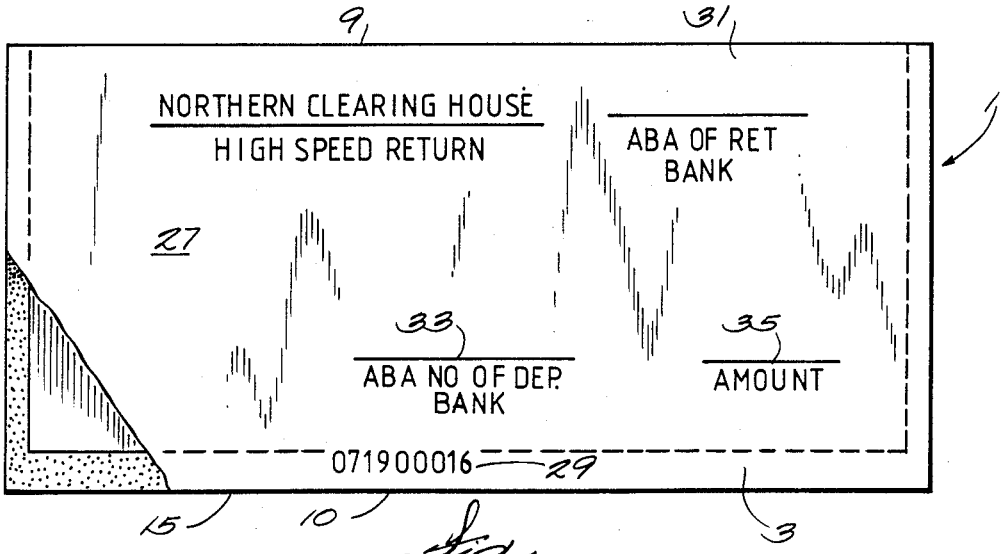
FIG. 1 is a front view of the document carrier envelope of the present invention.

Referring to FIG. 1, a document carrier envelope 1 is shown that includes the present invention. The document carrier envelope finds particular usefulness for protectively transporting checks in high speed check return operations, but it will be understood that the invention is not limited to check processing applications.

Figure 2:
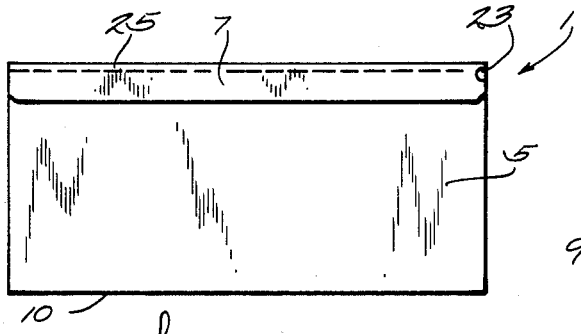
FIG. 2 is a back view of the document carrier envelope of the present invention showing the back flap in the sealed condition.
Figure 3:
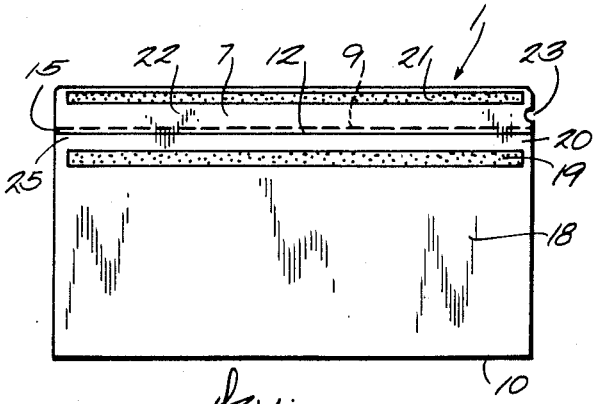
FIG. 3 is a back view of the document carrier envelope of the present invention shown with the flap in the unsealed condition.

Referring to FIGS. 1, 2, and 3, the document carrier envelope 1 includes a front panel 3, a back panel 5, and a flap 7. The flap 7 is joined to the front panel 3 along a perforated fold line 9. The front and back panels are joined along a common fold line 10.

Figure 4:
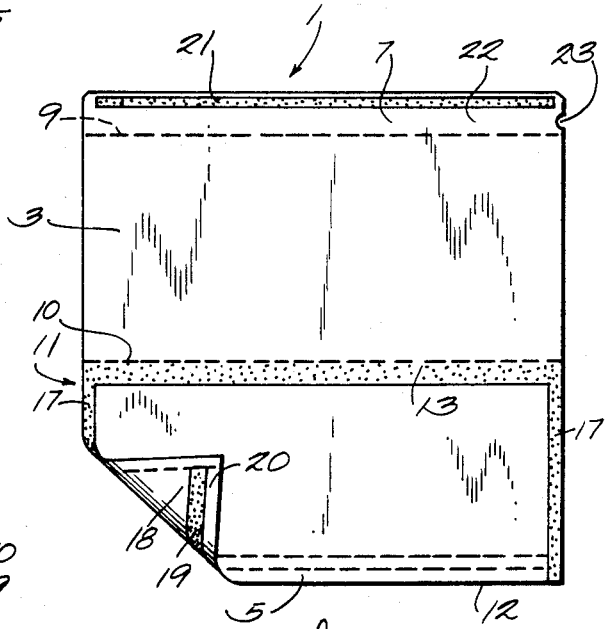
FIG. 4 is a front view of a blank of stock from which the document carrier envelope of the present invention may be made.

Referring to FIG. 4, a blank 11 of stock is shown from which the envelope 1 may be manufactured. The blank 11 is made of opaque stock. As shown in FIG. 2, the back panel 5 is slightly narrower than the front panel 3, so that when the panels are folded along the fold line 10, the free edge 12 of the back panel does not coincide with flap fold line 9, but rather is displaced therefrom by a space 15.

As shown in FIG. 4, one face of the back panel 5 has applied thereto a longitudinal strip of a suitable fastening material, such as an adhesive 13, adjacent the fold line 10. A pair of adhesive strips 17 are also applied to the back panel along the transverse margins on the same face as the strip 13. Preferably, the adhesive strips 17 extend the full length of the margins and intersect the longitudinal strip 13. Thus, when the back panel is folded along the fold line 10 into facing contact with the front panel, the adhesive strips 13 and 17 adhere to the front panel to create an envelope, FIG. 2. It will be appreciated that the adhesive strips may be applied to the front panel rather than to the back panel. The outside face 18 of the back panel is provided with a longitudinal strip 19 of a cohesive, which is preferably separated from the free edge 18 by a space 20. A similar cohesive strip 21 is deposited on the flap 7. The strip 21 is separated from the fold line 9 by a space 22. When the flap is folded over along fold line 9 onto the back panel, the cohesive strips 19 and 21 contact to seal the envelope substantially continuously along all four edges. Accordingly, a document within the envelope cannot become lost. In addition, because three margins of the back and front panels are joined in facing contact by the strips 13 and 17, the panels tend to lie flat. The perforated fold line 9 enables the flap to lie flat against the back panel with only minimal tendency to unfold. Consequently, air bubbles are inhibited from forming inside the envelope, and the envelope is readily acceptable by high speed check processing machinery. Moreover, the transverse panel margins joined by the strips 17 provide excellent leading edges for going through the processing machinery.

Further in accordance with the present invention, the flap 7 can optionally be manufactured with a notch 23 in at least one transverse edge thereof, FIGS. 2–4. In the preferred embodiment, the notch 23 is cut from the flat in the space portion 22 between the fold line 9 and the adhesive strip 21. It will be noticed in FIG. 3 that, when the flap is sealed, there is no sealing contact between the flap space 22 and the back panel space 20 and the space 15 between the back panel free edge 12 and the fold line 9. As a result, a passage way 25 extending the length of the envelope is created between the fold line 9 and the joined adhesive strips 19, 21. Thus, when the flap is sealed, the notch creates an entry into the passage way into which a conventional letter opener may be inserted for opening the envelope. The perforated nature of the fold line 9 enhances tearing along the fold line by the letter opener to very quickly open the envelope. Alternatively, enhanced opening capability may be provided by increasing the height of the flap 7 which would afford easier entry of a tool.

The present invention is also concerned with encoding the envelope 1 with data that renders it suitable for high speed check processing. For that purpose, the outside face 27 of the front panel 3 is imprinted with American Bankers Association MICROREAD encoding indicia 29 that indicates the document is a high speed return and identifies the clearing house. The front face 27 is also imprinted with form areas 31, 33, and 35 in which the returning institution encodes its American Bankers Association number, the American Bankers Association number of the bank of deposit and the amount of the check, respectively. Thus, the return check is fully processible by automated machinery when it is enclosed within the envelope, because all the requisite information is on the outside of the envelope.

Pursuant to the invention, the document enclosed in the envelope 1 is completely protected on its journey from the returning institution to the institution of deposit. Return endorsements and spray trace numbers are made on the outside face 18. That prevents destruction or overprinting of the original endorsement and allows easy traceback of both the check and the envelope in the forward and return directions.

To allow processing the envelope 1 and check through every kind of proof equipment and high speed readers and sorters, the stock of the blank 11 is of a carefully controlled quality and thickness. The preferred stock material is a 20-pound calendar bond paper about 0.004 inches thick that accepts printing so as to have high quality readability. It is further preferred that the material be of a distinct color, such as pink, which is easily distinguished from the color of other documents with which it may be associated and processed. The preferred envelope size is about 9 inches long by 4 inches wide. Envelopes made according to the present invention have a reject rate of less than 0.0025%.

Thus, it is apparent that there has been provided, in accordance with the invention, a document carrier envelope which fully satisfies the aims and advantages set forth above. While the invention has been described in conjunction with specific embodiments thereof, it is evident that many alternatives, modifications, and variations will be apparent to those skilled in the art in light of the foregoing description. Accordingly it is intended to embrace all such alternatives, modifications, and variations as fall within the spirit and broad scope of the appended claims.

What is claimed is:

1. A document carrier envelope for protectively transporting a document through high speed processing equipment comprising:

a. a front panel having an outside face imprinted with predetermined financial indicia readable by the high speed processing equipment and an unprinted inside face;

b. a back panel joined to the front panel along a first fold line and having opposed transverse edges and a free longitudinal edge, the back panel having first fastening means applied to the margins thereof along the transverse edges and second fastening means applied thereto adjacent the first fold line, both fastening means being applied to the same panel face, the back panel being folded over along the first fold line into facing contact with the front panel inside face to join the front and back panels along the first and second fastening means; and c. a flap having a pair of opposed transverse edges and joined to the front panel along a second fold line, the flap being adapted to fold over onto the back panel along the second fold line, the second fold line being perforated, the flap having fastening means applied longitudinally thereto at a spaced distance from the second fold line, the flap defining a notch in at least one transverse edge thereof generally in the space between the second fold line and the flap fastening means, so that when the flap is folded over onto the back panel, the document carrier envelope is sealed along the four edges thereof and the notch provides an entry for receiving a tool for rapidly opening the document carrier envelope.

2. The document carrier envelope of claim 1 wherein the front and back panels and the flap are fabricated from an opaque material, so that the confidentiality of the document transported in the document carrier envelope is preserved.

3. The document carrier envelope of claim 2 wherein the first and second fastening means applied to the back panels are strips of adhesive compatible with the opaque material.

4. The document carrier envelope of claim 2 wherein the first fastening means applied to the back panel transverse margins extends the full length thereof and intersects the second fastening means applied adjacent the first fold line, so that when the flap is folded over onto the back panel the document carrier envelope is sealed substantially continuously along the four edges thereof and entry of air into the envelope is prevented to thereby enhance handing thereof by the high speed processing equipment.

5. The document carrier envelope of claim 2 wherein:

a. the free longitudinal edge of the back panel is spaced from the second fold line when the back panel is in folded and sealed relation to the front panel;

b. the fastening means applied to the flap is a first strip of cohesive; and c. a second strip of cohesive compatible with the first strip of cohesive is applied longitudinally to the back panel at a location spaced from the free longitudinal edge thereof and coincident with the first strip of cohesive when the flap is folded over onto the back panel, so that when the flap is folded over and sealed to the back panel a longitudinal passage way is created between the second fold line and the sealed first and second strips of adhesive to facilitate opening the envelope by the use of a letter opening tool.

6. The document carrier envelope of claim 2 wherein:

a. a return check is transported by the document carrier envelope; and b. the financial indicia printed on the outside face of the front panel indicates the envelope as a high speed check return and identifies at least one clearing house for processing the return check.

7. The document carrier envelope of claim 6 wherein the financial indicia imprinted on the outside face of the front panel further includes form areas for receiving coded information identifying the financial institutions processing the return check and the amount of the return check.

8. A document carrier envelope for protectively transporting a document through high speed processing equipment comprising:

a. a front panel having an outside face imprinted with predetermined financial indicia readable by the high speed processing equipment and an unprinted inside face;

b. a back panel joined to the front panel along a first fold line and having opposed transverse edges and a free longitudinal edge, the back panel having first fastening means applied to the margins thereof along the transverse edges and second fastening means applied thereto adjacent the first fold line, both fastening means being applied to the same panel face, the back panel being folded over along the first fold line into facing contact with the front panel inside face to join the front and back panels along the first and second fastening means; and c. a flap having a pair of opposed transverse edges and joined to the front panel along a second fold line, the flap being adapted to fold over onto the back panel along the second fold line, the second fold line being perforated, the flap having fastening means applied longitudinally thereto at a spaced distance from the second fold line, the front and back panel being made from paper 0.004 inches thick.

9. The document carrier envelope of claim 8 wherein the front and back panels and the flap are fabricated from an opaque material, so that the confidentiality of the document transported in the document carrier envelope is preserved.

10. The document carrier envelope of claim 9 wherein the first and second fastening means applied to the back panels are strips of adhesive compatible with the opaque material.

11. The document carrier envelope of claim 9 wherein the first fastening means applied to the back panel transverse margins extends the full length thereof and intersects the second fastening means applied adjacent the first fold line, so that when the flap is folded over onto the back panel the document carrier envelope is sealed substantially continuously along the four edges thereof and entry of air into the envelope is prevented to thereby enhance handing thereof by the high speed processing equipment.

12. The document carrier envelope of claim 9 wherein:

a. the free longitudinal edge of the back panel is spaced from the second fold line when the back panel is in folded and sealed relation to the front panel;

b. the fastening means applied to the flap is a first strip of cohesive; and c. a second strip of cohesive compatible with the first strip of cohesive is applied longitudinally to the back panel at a location spaced from the free longitudinal edge thereof and coincident with the first strip of cohesive when the flap is folded over onto the back panel, so that when the flap is folded over and sealed to the back panel a longitudinal passage way is created between the second fold line and the sealed first and second strips of adhesive to facilitate opening the envelope by the use of a letter opening tool.

13. The document carrier envelope of claim 9 wherein:

a. a return check is transported by the document carrier envelope; and b. the financial indicia printed on the outside face of the front panel indicates the envelope as a high speed check return and identifies at least one clearing house for processing the return check.

14. The document carrier envelope of claim 13 wherein the financial indicia imprinted on the outside face of the front panel further includes form areas for receiving coded information identifying the financial institutions processing the return check and the amount of the return check.

* * * * *